United States Patent [19]

Christman

[11] Patent Number: 4,981,075

[45] Date of Patent: Jan. 1, 1991

[54] SHEET STRETCHING HOLDING FRAME

[75] Inventor: Vivan A. Christman, Clemmons, N.C.

[73] Assignee: Xpres Corporation, Winston-Salem, N.C.

[21] Appl. No.: 329,994

[22] Filed: Mar. 29, 1989

[51] Int. Cl.[5] ..... B05C 17/08

[52] U.S. Cl. ..... 101/127.1; 101/128.1

[58] Field of Search ..... 101/127.1, 128, 128.1, 101/127

[56] References Cited

U.S. PATENT DOCUMENTS

| | | | |
|---|---|---|---|
| 1,277,248 | 8/1918 | Newgass | 101/127.1 |
| 2,071,458 | 2/1937 | Ennis | 101/128 |
| 3,463,587 | 8/1969 | Oltra et al. | 101/128.1 |

FOREIGN PATENT DOCUMENTS

| | | | |
|---|---|---|---|
| 6618424 | 7/1967 | Switzerland | 101/127.1 |
| 361903 | 2/1973 | U.S.S.R. | 101/127.1 |

*Primary Examiner*—Edgar S. Burr
*Assistant Examiner*—Ren Yan
*Attorney, Agent, or Firm*—Sprung Horn Kramer & Woods

[57] ABSTRACT

A sheet stretching apparatus is provided. The sheet stretching apparatus includes a first planar frame having a first circumferential portion having a given first radial width, a given first axial depth, a first outer edge and a first inner edge, a second planar frame having a second circumferential portion having a given second radial width, a given second axial depth, a second outer edge and a second inner edge and a third planar frame having a third circumferential portion having a given third radial width, a given third axial depth, a third outer edge and a third inner edge, wherein the third inner edge extends radially inwardly of the first inner edge and the second inner edge. An adhesive is used for adhering a flexible sheet to one surface of the first planar frame. A stretching member is attached to one surface of the third planar frame. The stretching member is adjacent to the third inner edge and is disposed radially inwardly of the first and second inner edges. The stretching member extends along the circumference of the third planar frame. Spring clips or spring clamps connect the three frames together in a superposed relationship with the first frame disposed between the second frame and the third frame and the one surface of the first frame facing the one surface of the third frame, wherein the stretching member has an axial depth such that when the three frames are connected together by the spring clips or spring clamps the sheet is stretched and held taut.

8 Claims, 6 Drawing Sheets

FIG.1
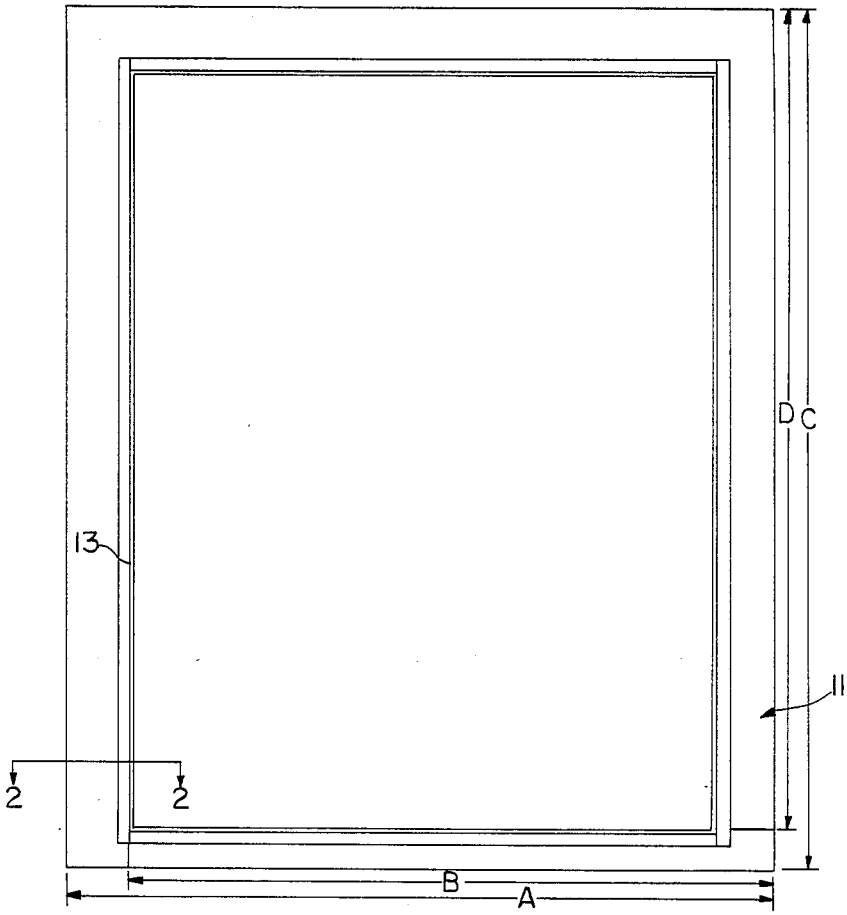
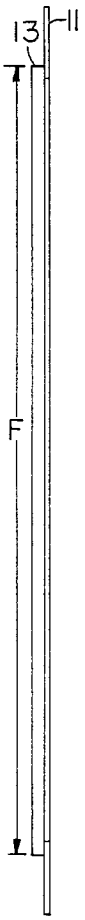
FIG.4
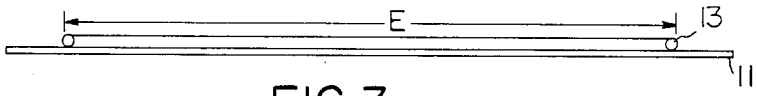
FIG.3
FIG.2
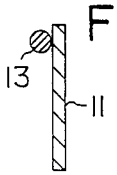

FIG.5 < A10

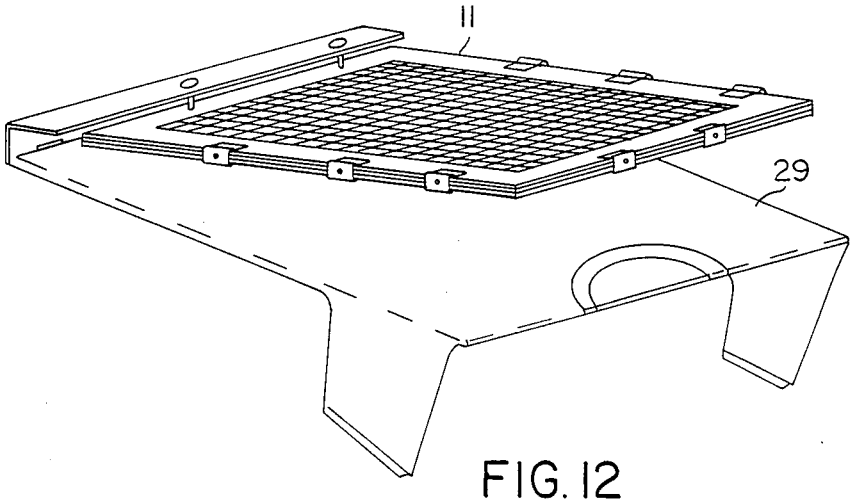
FIG. 12
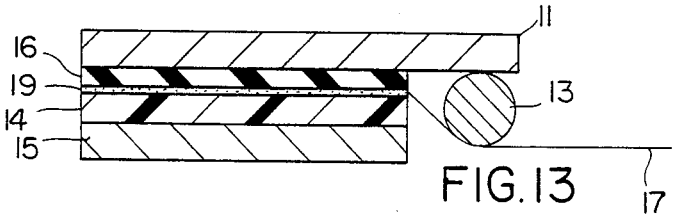
FIG. 13
FIG. 11
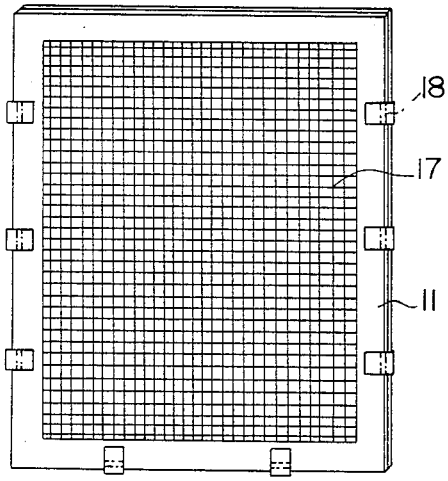

SHEET STRETCHING HOLDING FRAME

BACKGROUND OF THE INVENTION

1. Field of the Invention

The present invention concerns an apparatus for stretching, tightening, tensing and holding a sheet, e.g., a screen, a woven fabric, a tissue and/or another flat flexible substance or substrate. More particularly, the present invention is directed to stretching and holding screen printing screens to be used in screen printing.

2. Background Information

Prior to the invention of the present invention, screen, fabric, tissue and other material to be used in screen printing were stretched and held using one of the following devices and methods:

(1) Two inch by two inch pieces of wood were fastened at the ends to form 90° corners forming a frame, the total dimensions of which were not important. A piece of screen material (fabric, etc.) was then stapled, glued or attached by other means along one side. The screen material was then pulled by hand or through the use of a device which clamps onto the screen and can be used to pull the material tight across the frame. Once the material is tight in one dimension, additional clamps were attached to pull in opposition to each other, perpendicular to the first clamp, thereby removing all wrinkles, while holding the screen material tight over the wooden frame. Once tight, the screen material was fastened, stapled etc. onto each of the remaining four sides of the frame, holding the screen tight for use in screen printing.

Various methods have been devised to tighten the screen prior to fastening to the wood frame, but each method has several disadvantages, such as the following: (A) It is cumbersome and difficult to stretch the screen and fasten the screen. It remains difficult in spite of the development of expensive pneumatic screen streching devices that have been made to stretch and fasten screen material to wooden frames automatically. (B) It is not possible, or extremely difficult to retighten the screen once it has been fastened. (C) If the screen is to be saved, it must be saved in its stretched form on the large wooden frame.

Prolonged use or storage of this conventional device will cause the sheet material to sag.

(2) The Newman Roller Frame is an aluminum frame made to allow the user to retighten the screen after use. It works by first attaching the screen to the four sides that are made of round pipe material that is attached at the corners. A ratcheting device is employed such that the operator can tighten the screen by rotating the pipes, which pulls the screen tight in all directions. The Newman Roller Frame allows for superior tightening and retightening, but to use the same is time consuming and still does not allow the use an inexpensive alternative in saving the developed screens (the screen cannot be removed and reinstalled).

SUMMARY OF THE INVENTION

It is an object of the invention to provide a system to stretch a screen, woven fabric, tissue, etc., and to hold it so that it can be used as a screen for printing in conventional screen printing devices.

It is another object of the invention to enable the screen material to be stretched quickly (in less than one minute vs. several minutes for traditional stretching devices).

It is another object of the invention to enable the screen to be saved for reuse without the necessity of saving the stretching/holding device.

It is another object of the invention to enable the screen to be restretched for each use.

It is still another object of the invention to provide a stretching/holding device wherein the sheet material will not sag after prolonged use or storage of the device.

The above objects and other objects, aims and advantages are provided by the present invention.

The present invention concerns an apparatus for stretching a sheet, e.g., a screen, a fabric, a tissue, a web, etc. and holding it tight for screen printing comprising a. a first planar frame having a first circumferential portion having a given first radial width, a given first axial depth, a first outer edge and a first inner edge, b. a second planar frame having a second circumferential portion having a given second radial width, a given second axial depth, a second outer edge and a second inner edge, c. a third planar frame having a third circumferential portion having a given third radial width, a given third axial depth, a third outer edge and a third inner edge, wherein the third inner edge extends radially inwardly of the first inner edge and the second inner edge, d. means for adhering a flexible sheet to one surface of the first planar frame, e. a stretching member attached to one surface of the third planar frame, the stretching member adjacent to the third inner edge and disposed radially inwardly of the first and second inner edges, the stretching member extending along the circumference of the third planar frame, and f. means for connecting the first, second and third frames together in a superposed relationship with the first frame disposed between the second frame and the third frame and the one surface of first frame facing the one surface of the third frame, wherein the stretching means has an axial depth such that when the three frames are connected together by the connecting means the sheet is stretched and held taut.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a plan view of an upper frame of a screen stretching holding frame according to the present invention.

FIG. 2 is a sectional view taken along line 2—2 of FIG. 1.

FIG. 3 is a side view of the upper frame depicted in FIG. 1.

FIG. 4 is another side view of the upper frame depicted in FIG. 1.

FIG. 5 is a cross-sectional view of the upper frame, placement frame and lower frame of an apparatus according to the present invention.

FIG. 11 is a perspective view of a screen stretching holding frame according to the present invention.

FIG. 12 is a perspective view depicting the screen stretching holding frame depicted in FIG. 11 as attached to a conventional screen printing stand.

FIG. 13 is a cross-sectional view of the upper frame, placement frame and lower frame of an apparatus according to the present invention.

DETAILED DESCRIPTION OF THE INVENTION

Figure 6:
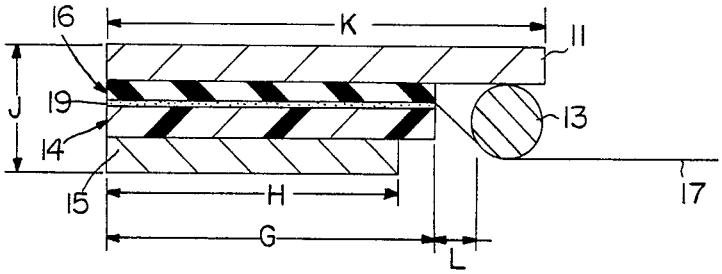
FIG. 6 is a plan view depicting a lower frame of a screen stretching holding frame according to the present invention.
Figure 7:
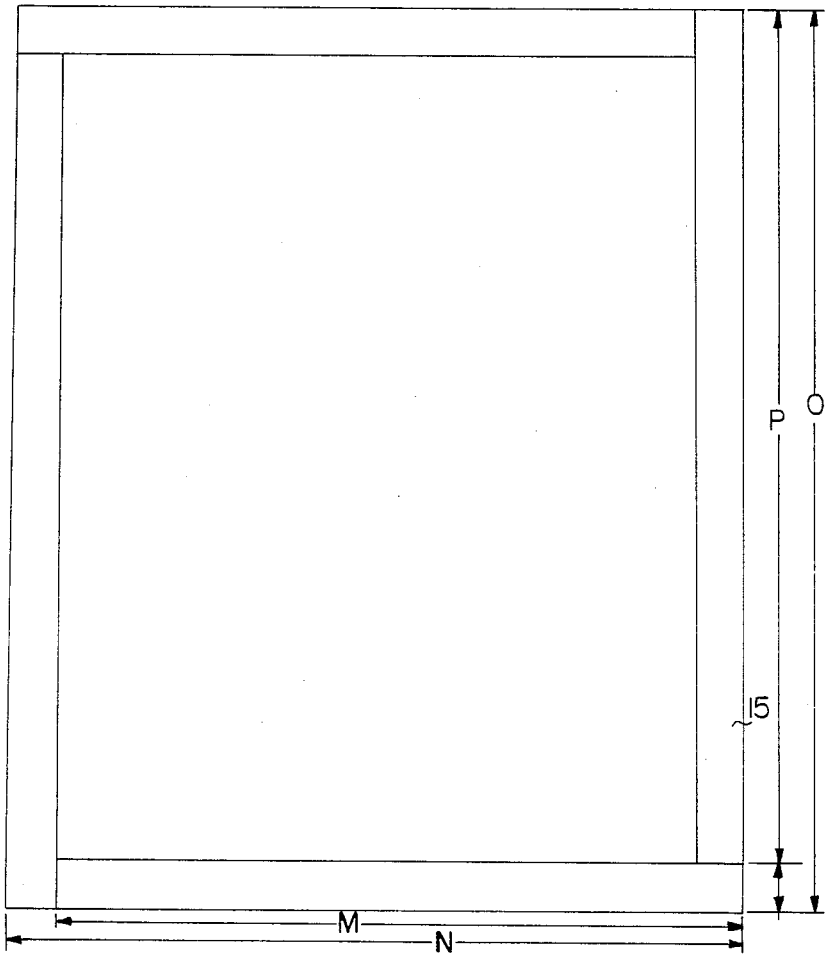
FIG. 7 is a side view of the lower frame depicted in FIG. 1.

The present invention concerns a sheet, e.g., a screen, stretching apparatus which preferably comprises (A) a thin, lightweight, inexpensive, rectangular placement frame, that has adhesive applied to one side onto which the sheet, e.g., screen, etc. can be quickly set, which will cause the sheet, e.g., screen, to be held in a flat orientation, (B) a lower flat, rectangular frame of the same or about the same dimensions as the placement frame, onto which the placement frame is placed, with the sheet material facing up, (C) an upper, rectangular frame having a wider side surface such that when the upper frame is placed on top of the lower frame and placement frame and the outer edges aligned, the inner edge of the upper frame extends inside of the lower frame and placement frame onto the inner edge of the upper frame; on the bottom side of the upper frame is a "spongy" gasket, for example, rubber strips, (attached to all sides of the frame) which serve to hold the placement frame securely against the upper frame; the placement frame lies directly on these rubber strips which are cut to the dimensions of the upper frame; attached is a round (other shapes can also be used) rod, i.e., a tube or a rod, that pushes the screen down along all sides of the frame, extending the screen downward causing the screen material to be pulled tight in all directions, providing an ideal surface for screen printing; preferably the axial depth of the rod is greater than the axial depth of the gasket and (D) a means of clamping the lower placement, and upper frames together which may involve the use of hinges along one side and various spring clamping devices along the other sides as needed to achieve the desired screen tightness.

It is preferred that all three frames have continuous circumferences. It is also preferred that the placement frame and the lower frame have congruent concentric inner edges.

Referring to the drawings, in all of which like parts are designated by like reference numbers, the upper frame 11 of a screen stretching holding frame according to the present invention is depicted in FIG. 1 and FIG. 2. The upper frame 11 is preferably fabricated from metal, e.g., steel or aluminum, preferably ⅛" thick aluminum, and round rods 13 which are welded to the inner circumference of upper frame 11. Although the corners of the upper frame 11 are squared, such corners could be rounded off.

Preferred dimensions for the upper frame 11 as depicted in FIGS. 1, 3 and 4 are as follows:

| | |
|---|---|
| A | 15⅛ inches |
| B | 13⅝ inches |
| C | 18⅛ inches |
| D | 16⅝ inches |
| E | 12¾ inches |
| F | 15¾ inches. |

FIGS. 5 and 13 depict, in cross-section, the upper frame 11 and rod 13 (preferably rod 13 is a ¼ inch diameter aluminum), the placement frame 14 and the lower frame 15 of a screen stretching holder frame according to the present invention. A "spongy" gasket 16 (preferably fabricated from 1/16 inch neoprene rubber) is disposed between upper frame 11 and screen frame (placement frame) 14. A silk screen 17 is disposed between gasket 16 and screen frame 14. The screen frame 14 is preferably thin, lightweight and inexpensive and is preferably made from 3 mm or ⅛ inch plywood or plastic. Adhesive 19 is applied to the side of the screen frame 14 which faces the silk screen 17.

Preferred dimensions as depicted in FIG. 5 are as follows:

| | |
|---|---|
| G | 1⅛ inches |
| H | 1 inch |
| J | 7/16 inch |
| K | 1½ inches |
| L | ⅛ inch. |

FIG. 6 depicts lower frame 15, which is preferably fabricated from metal, e.g., aluminum or steel, preferably ⅛ inch thick aluminum.

Preferred dimensions for the lower frame as depicted in FIG. 6 are as follows:

| | |
|---|---|
| M | 14.125 inches |
| N | 15.125 inches |
| O | 18.125 inches |
| P | 17.125 inches. |

Figure 8:
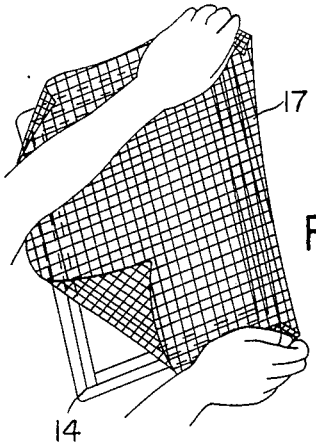
FIG. 8 is a perspective view depicting a screen material being applied to a placement frame of a screen stretching holding frame according to the present invention.

In FIG. 8 there is depicted the attachment of screen material 17 to placement frame 14. The side of placement frame 14 facing the screen material 17 is lined with adhesive, either from double stick tape or from glue. After the screen material 17 is adhered to frame 14, excess screen material is trimmed away from the edges using a scissor or a knife.

Figure 9:
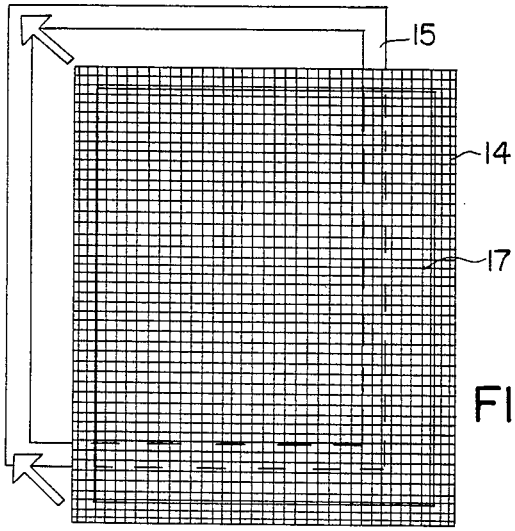
FIG. 9 is an elevational view depicting the placement frame being placed over the lower frame of a screen stretching holding frame according to the present invention.

In FIG. 9, there is depicted the placement of frame screen 14 (such as that obtained from the procedure depicted in FIG. 5) on the lower frame 15, such that the surface of the frame 14 not covered by screen material 17 lies directly on lower frame 15.

After the positioning as depicted in FIG. 5 is completed, there results a "stretched" frame, i.e., the screen material 17 is stretched.

Figure 10:
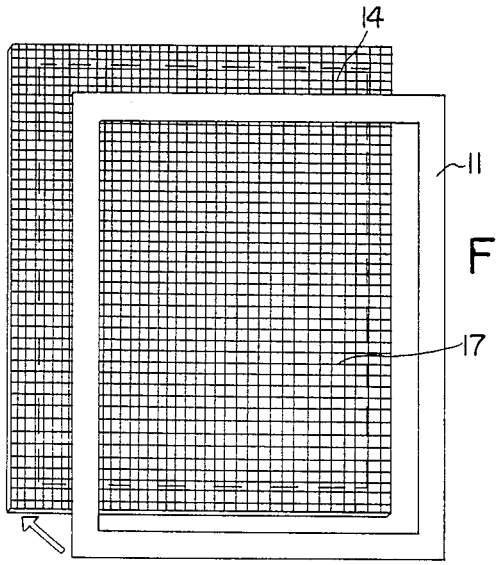
FIG. 10 is an elevational view depicting the upper frame being positioned against the placement frame and the lower frame of a screen stretching holding frame according to the present invention.

FIG. 10 depicts the closing of the "stretching" apparatus by placing the upper frame 11 directly on the "stretched" frame such as that obtained from FIG. 9. The flat "metal" side of upper frame 11 should face up, while the side with the gasket 16 faces down. After the positioning as depicted in FIG. 10 is completed, the "stretched" frame is "sandwiched" between the upper frame 11 and lower frame 15.

FIG. 11 depicts a screen stretching holding frame according to the present invention having spring clips 18 which hold all the frames 11, 14 and 15 together.

The spring clips or clamps 18 are placed on all sides of the device, except for the top (during printing the top of the device can be secured).

FIG. 12 shows a screen stretching holding frame according to the invention attached to a conventional screen printing stand 29. The device as depicted in FIG. 12 is ready for printing.

A conventional screen printing screen is made of a nylon or polyester woven fabric. Using certain convention screen holding devices, the polyester or nylon fabric will stretch if held under pressure for an extended time. This causes a major problem with certain conventional screen stretching/holding frames because it is almost impossible to re-tighten. The inventive screen stretching/holding system offers a major advantage over the conventional systems because the screen is held tight only while it is being used. During storage it remains attached to the holding/ orientating frame in a relaxed position.

Further, the inventive screen stretching/holding system has another advantage in that in a preferred embodiment of the invention as discussed in detail hereinbelow, the exact tightness of the screen is determined by the amount of spring tension applied by spring holding clips. In the present invention the three screen frames normally do not come into tight contact unless the screen is very loosly attached to the orienting frame, thereby allowing a self regulating method of maintaining the same screen tension even after extended use, whereby the screen (nylon or polyester) has started to stretch.

In a preferred embodiment of the present invention spring tension clamps or clips are utilized on three sides of the inventive device. Such spring tension clamps are preferably made of spring steel or other material which would impart a spring tension. Alternatively, a spring can be utilized. The purpose of the spring tension clamps are to allow a self-regulating mechanism to maintain a constant tension across the surface of the sheet material even after extended use or storage, which would otherwise sag, thereby alowing the user to produce more uniform prints when the apparatus is used for screen printing.

It is further preferred to employ the aforesaid spring clamps in conjunction with a "spongy" gasket, which gasket is disposed between the placement frame and the upper frame.

It will be appreciated that the instant specification and claims are set forth by way of illustration and not limitation, and that various modifications and changes may be made without departing from the spirit and scope of the present invention.

What is claimed is:

1. A sheet stretching apparatus comprising (a) a first planar frame having a first circumferential portion having a given first width, a given first axial depth, a first outer edge and a first inner edge, (b) a second planar frame having a second circumferential portion having a given second width, a given second axial depth, a second outer edge and a second inner edge, (c) a third planar frame having a third circumferential portion having a given third width, a given third axial depth, a third outer edge and a third inner edge, wherein the third inner edge extends radially inwardly of the first inner edge and the second inner edge, (d) a spongy gasket means disposed between said third planar frame and said first planar frame, (e) means for adhering a flexible sheet to one surface of the first planar frame, (f) a stretching member attached to one surface of the third planar frame, said stretching member adjacent to the third inner edge and disposed radially inwardly of said first and second inner edges, said stretching member extending along the circumference of the third planar frame, and (g) means for dynamically connecting the three frames together in a superposed relationship with the first frame disposed between the second frame and the third frame and the one surface of the first frame facing the one surface of the third frame, said means for connecting comprising a plurality of spring clips or spring clamps, wherein the stretching means has an axial depth such that when the first, second and third frames are connected together by the connecting means the sheet is stretched and held taut.

2. A sheet stretching apparatus according to claim 1, wherein the first planar frame, the second planar frame and the third planar frame are all rectangular.

3. A sheet stretching apparatus according to claim 1, wherein the axial depth of the stretching member is greater than the axial depth of the spongy gasket means.

4. A sheet stretching apparatus according to claim 1, wherein said first planar frame and said second planar frame have congruent concentric inner edges.

5. A sheet stretching apparatus according to claim 1, wherein the stretching member is a tube.

6. A sheet stretching apparatus according to claim 1, wherein the stretching member is a rod.

7. A sheet stretching apparatus according to claim 1, wherein the first, second and third planar frames have continuous circumferences.

8. A sheet stretching apparatus according to claim 1, wherein the means for adhering the flexible sheet is adhesive.

* * * * *